US005694720A

United States Patent [19]

Walcher et al.

[11] Patent Number: 5,694,720

[45] Date of Patent: *Dec. 9, 1997

[54] STANDING CLAMP FOR STANDING SEAM ROOF

[75] Inventors: James G. Walcher, Williard; James R. Limbird, Attica, both of Ohio

[73] Assignee: Safety Equipment, Inc., Monroeville, Ohio

[ * ] Notice: The term of this patent shall not extend beyond the expiration date of Pat. No. 5,433,044.

[21] Appl. No.: 502,707

[22] Filed: Jul. 14, 1995

Related U.S. Application Data

[63] Continuation-in-part of Ser. No. 226,204, Apr. 11, 1994, Pat. No. 5,433,044.

[51] Int. Cl.[6] ..... A62B 35/00; A62B 1/00; E04G 21/32

[52] U.S. Cl. ..... 52/111; 52/703; 52/749.12; 52/DIG. 12; 248/237; 182/3; 182/45

[58] Field of Search ..... 52/749.12, 745.21, 52/698.24, 713, 127.2, DIG. 1, DIG. 12; 269/153, 152, 43, 244

[56] References Cited

U.S. PATENT DOCUMENTS

| | | | |
|---|---|---|---|
| 287,271 | 10/1883 | Gladwin | 269/153 X |
| 1,054,091 | 2/1913 | Darnall . | |
| 1,453,018 | 4/1923 | McHewitt et al. . | |
| 2,317,195 | 4/1943 | Husted | 269/244 X |
| 2,662,433 | 12/1953 | Braun | 269/244 X |
| 4,341,375 | 7/1982 | Romanin | 269/43 |
| 4,685,663 | 8/1987 | Jorgensen | 269/244 |
| 4,704,829 | 11/1987 | Baumker | 52/127.2 |
| 5,152,107 | 10/1992 | Strickert | 52/24 |
| 5,433,044 | 7/1995 | Walcher et al. | 52/111 |

*Primary Examiner*—Robert Canfield

*Attorney, Agent, or Firm*—Ralph E. Jocke; Michael C. Popnal

[57] ABSTRACT

A safety clamp (10) attaches a safety cable (48) to standing seams (14) of a roof deck (12). The safety clamp has a housing (16) with a movable member (20) mounted therein. The housing has first tabs (18) that extend outward thereon and are engageable with first sides of the standing seams. The movable member has second tabs (22) mounted thereon that extend through cut-outs (24) in the housing. The safety clamp is attachable to the standing seams by moving a threaded member (38) to hold three standing seams in clamped relation between the tabs.

16 Claims, 4 Drawing Sheets

STANDING CLAMP FOR STANDING SEAM ROOF

CROSS REFERENCE TO RELATED APPLICATION

This Application is a continuation-in-part of U.S. application Ser. No. 08/226,204 filed Apr. 11, 1994, which is now U.S. Pat. No. 5,433,044.

TECHNICAL FIELD

This invention relates to safety devices used in the construction industry. Particularly this invention relates to a safety clamp used to secure a safety device such as a safety line to a standing seam type roof deck.

BACKGROUND ART

In the construction of buildings workers are often required to work on roof decks. In these situations it is desirable to secure the worker to a safety line to minimize the risk of falls.

A popular type of roof deck has roof panels that fit together at standing seams. The standing seams serve to interlock the panels which holds the panels of the roof together. The standing seams extend laterally across the roof. While standing seam roofs are an excellent type of roof construction, they provide no convenient location to attach a safety line or other safety device. Further, clamping a safety line to a single seam would not be acceptable because a single seam would not have sufficient strength to hold or support a worker.

Thus, there exists a need for a safety clamp to secure a safety device such as a worker's safety line to a standing seam type roof.

DISCLOSURE OF INVENTION

It is an object of the present invention to provide a safety clamp for securing a safety device.

It is a further object of the present invention to provide a safety clamp that can be attached to a standing seam roof.

It is a further object of the present invention to provide a safety clamp that has substantial strength.

It is a further object of the present invention to provide a safety clamp that may be readily installed and removed.

It is a further object of the present invention to provide a safety clamp that may be used to secure a worker's safety line or de-reeler.

It is a further object of the present invention to provide a safety clamp that is economical.

Further objects of the present invention will be made apparent in the following Best Mode For Carrying Out Invention in the appended claims.

The foregoing objects are accomplished in the preferred embodiment of the invention by a safety clamp for attachment to a standing seam roof deck. The safety clamp has a housing, which is a first member, which is rectangular in cross-section and sufficiently long to traverse three standing seams of the roof deck. The housing has an interior area with three cut-outs which are each positioned to be adjacent to a standing seam. The housing also includes three first tabs which extend from the housing in a first direction. The first tabs are positioned on the housing to each engage a first side of a standing seam.

A movable member, which is a second member, is mounted for longitudinal movement in the interior area of the housing. The movable member is also rectangular in cross-section, and is sized to move in slideably guided supporting relation inside the housing. The movable member has three second tabs mounted thereon. The second tabs extend through the cut-outs in the housing member. The second tabs are positioned to extend from the housing in a first direction and to be on a second opposed side of a standing seam opposite of the first tabs. The second tabs are generally "Z shaped" in cross-section, and have an outboard longitudinal projection that is sized for acceptance in a recess on the second side of each standing seam.

The housing has an end cap at first longitudinal end. The movable member has a member cap at an end adjacent the first end of the housing. A threaded member extends through the end cap of the housing and threadably engages the member cap. Turning the threaded member enables three standing seams to be clamped between the first and second tabs which secures the safety clamp to the roof.

The safety clamp of the preferred embodiment further includes a clevis on the side of the housing opposite the tabs. The clevis is attached to a device such as a worker's safety line and a de-reeler. The safety line is attached to a worker's safety harness. As a result, the worker may move about on the roof deck while tied off to the safety clamp, which minimizes the risk of falls.

BEST MODE FOR CARRYING OUT INVENTION

Figure 1:
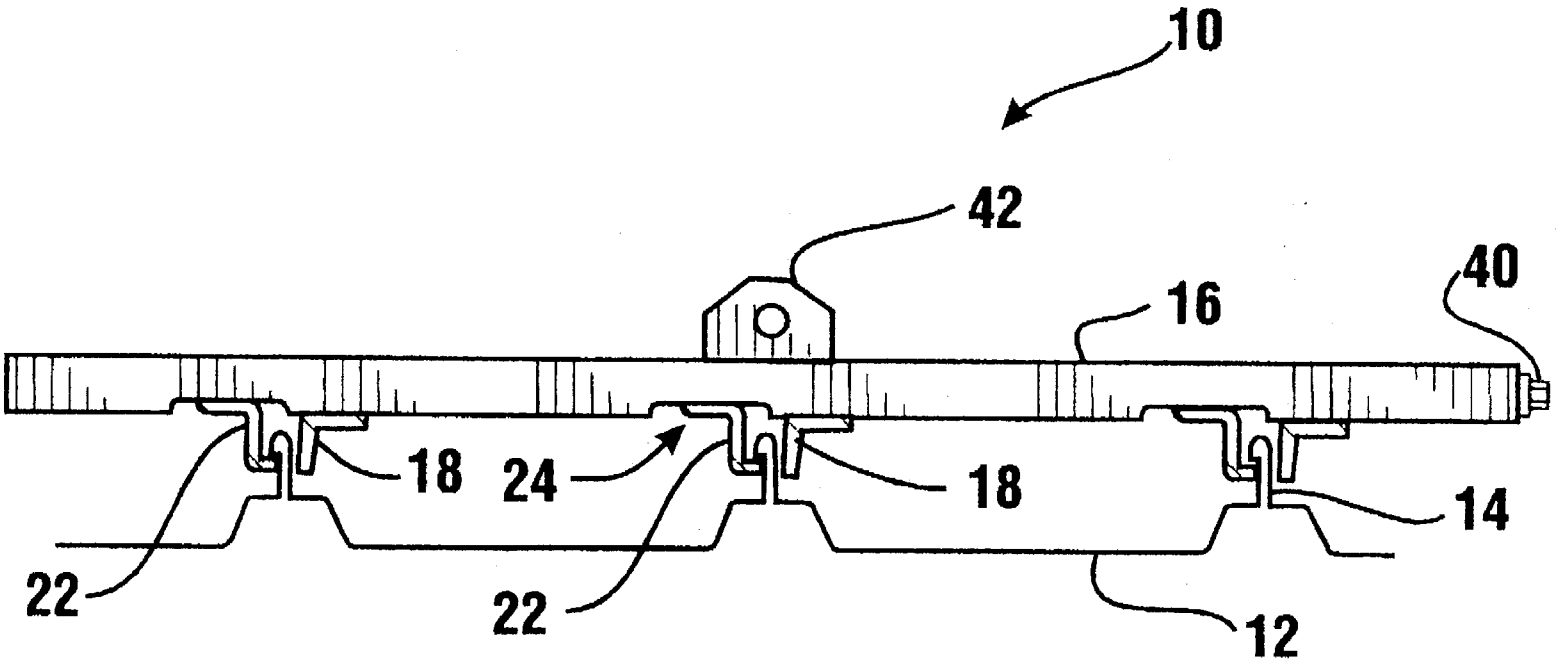
FIG. 1 is a side view of the safety clamp of the preferred embodiment of the present invention shown attached to a standing seam roof deck.

Referring now to the drawings, and particularly to FIG. 1, there is shown therein the preferred embodiment of the safety clamp of the present invention generally indicated 10. The safety clamp is shown attached to a standing seam roof deck 12 which has a plurality of longitudinally extending standing seams 14.

Safety clamp 10 has an outer housing member 16 that is generally rectangular in cross-section. The housing 16 has three first tabs 18 mounted thereon which extend from a first side of the housing. The first tabs 18 are generally "L-shaped" in cross-section, and are each engageable with a first side of a standing seam.

Figure 2:
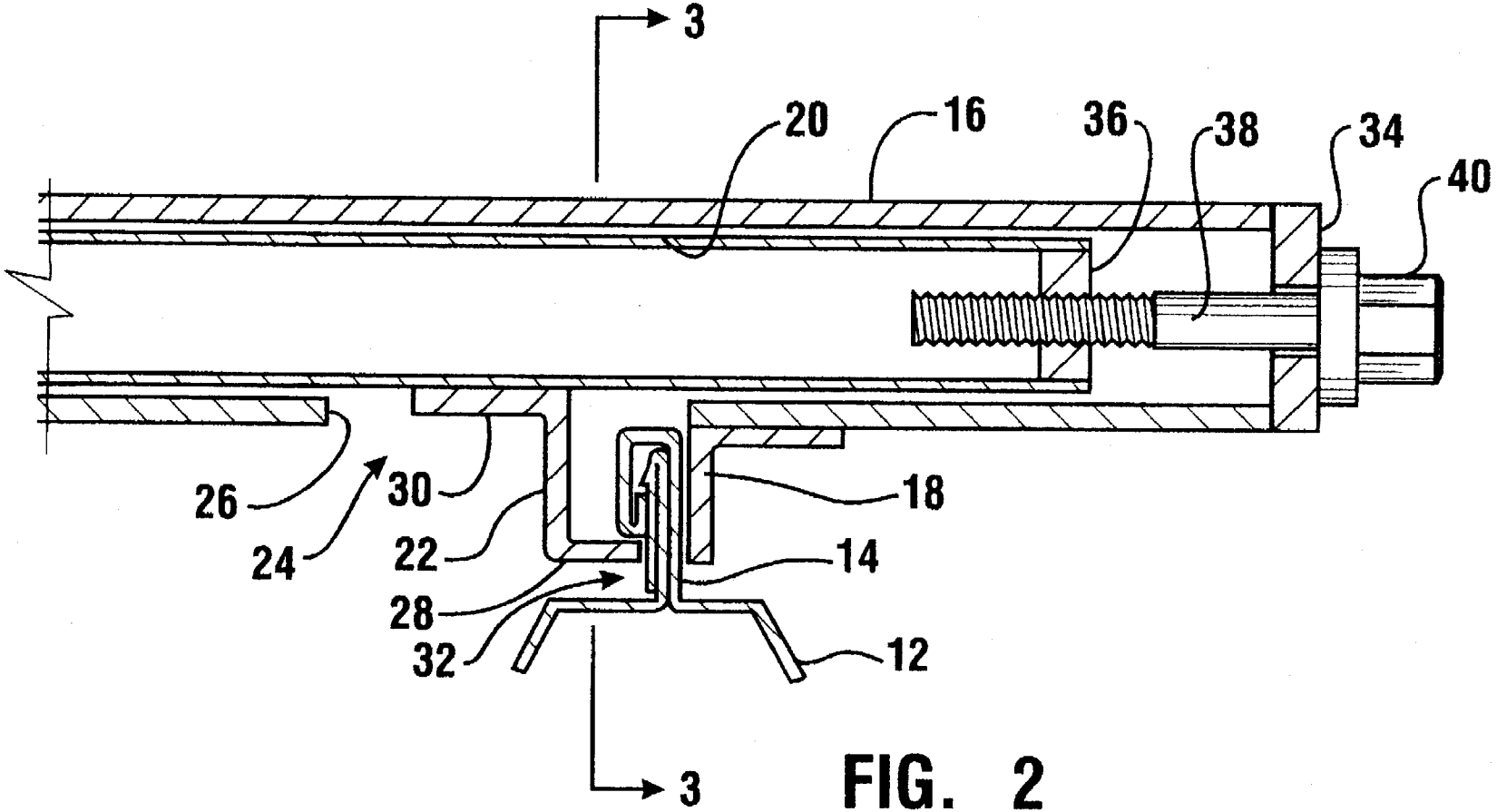
FIG. 2 is a partial cross-sectional view of the safety clamp and a standing seam.

A movable member 20 is mounted inside of housing 16 (see FIG. 2). Movable member 20 is also rectangular in cross-section and is sized to move longitudinally in slideably guided relation in the interior area of housing 16. Three second tabs 22 are mounted on movable member 20. Second tabs 22 extend through cut-outs 24 in housing 16. Cut-outs 24 are elongated longitudinally and are bounded on the sides away from the first tabs by a lip 26.

Figure 3:
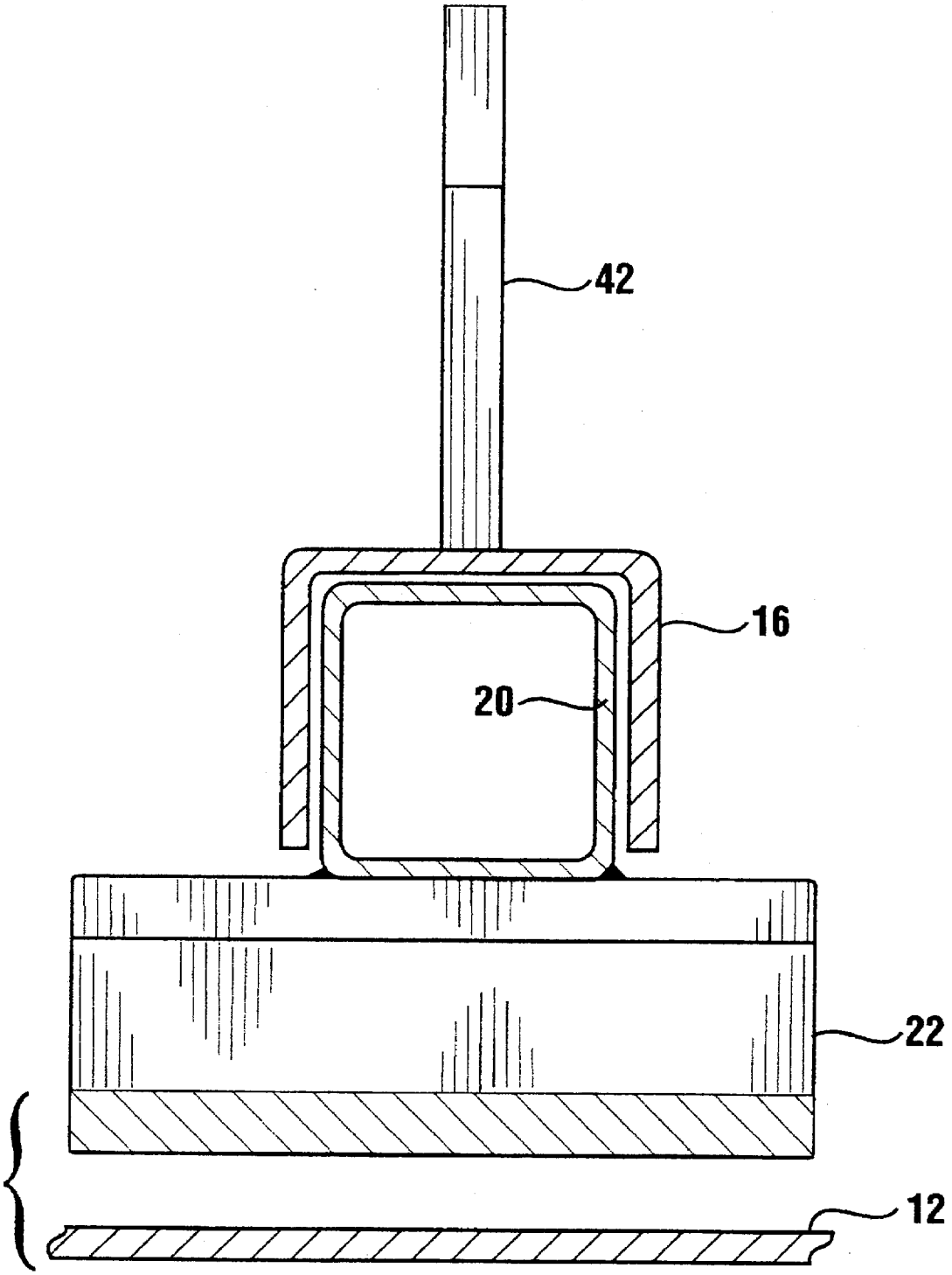
FIG. 3 is a cross-sectional view of the safety clamp and standing seam along line 3—3 in FIG. 2.

Second tabs 22 are generally "Z-shaped" in cross-section and include an outboard longitudinal projection 28 and an inboard longitudinal projection 30. In the preferred form of the invention, the standing seams 14 include recesses 32 on a second side. Outboard projection 28 is sized for acceptance in recesses 32. Further in the preferred embodiment as best shown in FIG. 3, the first tabs 18 and second tabs 22 are substantially wider than housing 16 for reasons that will be later explained.

An end cap 34 is positioned at a first longitudinal end of housing 16. A member cap 36 is positioned at an end of movable member 30 adjacent end cap 34. A threaded member 38 extends through end cap 34 and threadably engages member cap 36. Threaded member 38 has a head portion 40 at an outboard end that is readily attachable to a ratchet or other tool for rotating the threaded member. Movement of threaded member 38 in a first direction moves first tabs 18 and second tabs 22 closer together. Rotation of threaded member 38 in an opposed direction moves the tabs further apart. Separating movement of the tabs is restricted by inboard projections 30 of the second tabs 22 and lips 26 of the cut-outs which engage to prevent further separation of the tabs before threaded member 38 disengages from member 36.

Figure 4:
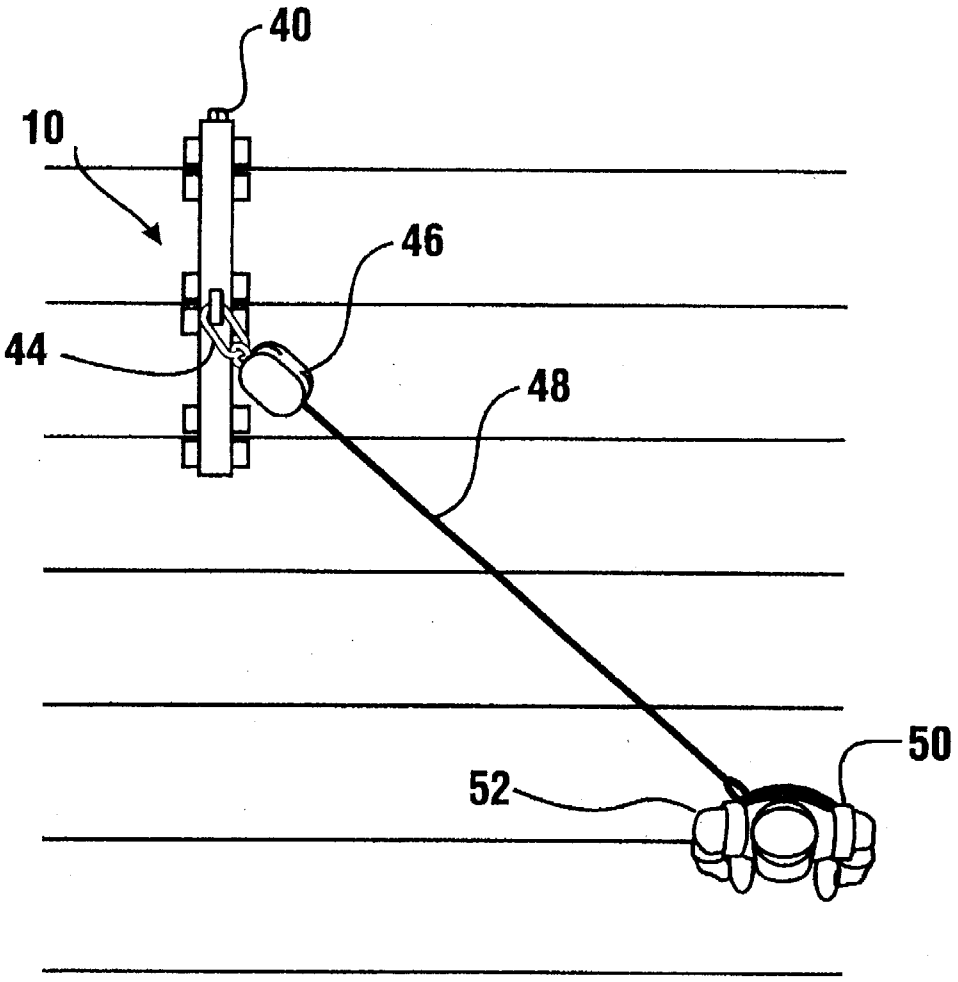
FIG. 4 is a top plan view of the safety clamp attached to a standing seam roof deck and a safety line of a worker.

Housing 16 further includes a clevis 42 on a side opposite the tabs. Clevis 42 includes an opening through which a safety device such as a ring 44 connected to a de-reeler 46 is attached (see FIG. 4). The de-reeler 46 is of the type known in the prior art which allows a safety cable 48 to move in and out of the de-reeler against a slight tension. The safety cable is attached to a safety harness 50 worn by a worker 52. The de-reeler 46 allows the safety cable to travel in and out relatively freely except in circumstances in which a sudden outward acceleration of the cable is sensed which may indicate a fall. In such circumstances, the de-reeler is designed to hold the cable 48 from further extension.

In operation, the cable clamp is first set on the roof deck 12 with the tabs separated sufficiently to accept a standing seam 14 between each pair of tabs. The clamp is positioned with the first tabs 18 on a first side of the standing seams and the second tabs 22 on an opposed side of the standing seams. Preferably the second side of the standing seams is the side having the recesses 32 thereon.

The threaded member 38 of the safety clamp is then rotated to draw the first and second tabs together so that the standing seams are in clamped relation between the tabs. As the tabs are drawn together the outboard projections 28 of the second tabs 22 nest in the recesses 32 of the standing seams. This provides a secure attachment. Because the tabs on the safety clamp are substantially wider than the housing, the amount of force required to pull the safety clamp from the standing seam once it has been properly attached thereto is very high.

While in the preferred embodiment the means for moving the movable member includes the threaded member 38, other embodiments may use other apparatus to accomplish movement thereof. Such apparatus may include without limitation, arrangements of levers or gears, or combinations thereof, or other types of actuatable mechanisms whether manually operated or otherwise, to move the first and second tabs into adjacent relation. All such apparatus which achieve movement of the movable member or the tabs are equivalent means which may be used successfully by those skilled in the art.

With the safety clamp securely attached to the standing seams, a de-reeler 46 or other safety device is attached to the clevis. A worker whose harness is attached to the safety cable which extends from the de-reeler is thereby securely attached to the roof deck. As a result the worker may move about the roof while minimizing the risk of falls.

If it is desired to move the position of the safety clamp, this may be readily accomplished by turning threaded member 38 to separate the first and second tabs and lifting the safety clamp upward therefrom.

Because the standing seams of the room deck are uniformly spaced across the roof, the safety clamp of the present invention may be conveniently installed at any location across the roof. Further, because the safety clamp has a central clevis design, the safety clamp may be installed equally well with the head portion of the threaded member pointed in either direction. This enables the safety clamp to take advantage of the engagement of the second tabs in the recesses of the standing seam regardless of which direction the recesses may be oriented.

In the preferred embodiment, the safety clamp is designed for use with standing seams spaced two feet apart on the roof decking. The housing of the preferred embodiment is made of two inch square tube with a movable member made of one and a half inch square tube. Each of these is made of high-strength steel material. The tabs of the safety clamp are approximately one-quarter inch thick steel and are made about four inches wide. The safety damp is preferably made as a weldment. The structure of the preferred embodiment is designed to serve as a safety clamp for holding a single worker's safety line. Of course, in other embodiments, other configurations and constructions may be used.

Alternative embodiments may include arrangements of multiple movable members supported on a housing or framework. Such alternative embodiments may engage multiple standing seams and may also engage each standing seam in at least two tranversely spaced locations. This may be accomplished in one embodiment by combining two devices similar to the preferred embodiment previously described with a transverse extending framework such that the tabs are engageable with each standing seam in transversely spaced locations. The clevis or other attachment device may be positioned in a suitable central or other location on the framework. Such multiple additional engagement points with the standing seams increases the strength with which the invention is held to a roof. As a result one or more workers may be tethered to such an alternative embodiment.

Thus the safety clamp of the present invention achieves the above-stated objectives, eliminates difficulties encountered in the use of prior devices and systems, solves problems, and attains the desirable results described herein.

In the foregoing description certain terms have been used for brevity, clarity, and understanding, however, no unnecessary limitations are to be implied therefrom because such terms are for descriptive purposes, and are intended to broadly construed. Moreover, the descriptions and illustrations given are by way of examples and the invention is not limited to the exact details shown or described.

Having described the features, discoveries, and principles of the invention, the manner in which it is utilized and the advantages and useful results attained; the new and useful structures, devices, elements, arrangements, parts, combinations, systems, equipment, operations, methods and relationships are set forth in the appended claims.

We claim:

1. An apparatus for mounting a device to a roof having a plurality of standing seams, comprising:

a housing;

at least two first tabs in connected relation with said housing, wherein each of said first tabs is engageable with a side of said standing seams;

at least two second tabs, wherein each said second tab is adjacent a first tab and engageable with said standing seams on a side opposed from said first tabs;

at least one actuatable mechanism, wherein said actuatable mechanism is operative to move said adjacent first and second tabs into closer relation, wherein said actuatable mechanism includes a threaded member, whereby said apparatus is operative to clamp a standing seam positioned intermediate said first and second tabs.

2. A method for mounting a device to a standing seam roof wherein said device is in connected relation with a plurality of first tabs and a plurality of second tabs, each of said first tabs being movable relative to said second tabs, comprising the steps of:

engaging each of said plurality of first tabs with a first side of a standing seam; and engaging each of said plurality of second tabs with a second opposed side of said standing seam, whereby said standing seam is held in clamped relation between said first and second tabs.

3. The apparatus according to claim 1, wherein said actuatable mechanism includes a movable member and wherein said second tabs are operatively connected to said movable member.

4. The apparatus according to claim 1, further comprising a dereeler, wherein said dereeler is operatively connected to said housing.

5. The apparatus according to claim 1, wherein said housing extends in a longitudinal direction, and wherein said first tabs are disposed from one another in a direction transverse to said longitudinal direction, whereby said first tabs are engageable with a standing seam in transversely disposed locations.

6. The apparatus according to claim 1, further comprising at least one moveable member, wherein said moveable member is positioned within said housing for movement therein.

7. The apparatus according to claim 6, wherein at least one of said second tabs is in connected relation with said moveable member.

8. The apparatus according to claim 1, wherein said actuatable mechanism includes a threaded member.

9. An apparatus for mounting a device to a roof having a plurality of standing seams, wherein each standing seam includes a vertical first side and a vertical second side, said second side being generally opposed to said first side, said apparatus comprising:

a housing;

at least one movable member movably extending in said housing;

a plurality of first and second clamping tabs;

wherein at least one first clamping tab is operatively connected to said housing, and wherein said one first clamping tab is engageable with a first side of a first standing seam;

wherein at least one second clamping tab is operatively connected with said movable member, and wherein movement of said movable member is operative to move said second clamping tab, whereby said second clamping tab is engageable with a second side of a second standing seam further comprising a threaded member, wherein said threaded member is in operative connection with said movable member, and a further first clamping tab wherein said further first clamping tab is adapted to be positionable adjacent said one second clamping tab and on an opposed side of said second standing seam, and wherein said one second clamping tab and said further first clamping tab move towards each other responsive to rotation of said threaded member, whereby said second clamping tab and said further first clamping tab are engageable with said second standing seam.

10. An apparatus according to claim 9, further comprising:

a second housing, extending in a direction generally parallel to said first housing, a second moveable member positioned within said second housing.

11. An apparatus according to claim 10, wherein said first and second housings are generally tubular, and said first and second moveable members are positionable within said first and second housings respectively.

12. An apparatus according to claim 10, and further comprising a connecting member, wherein said connecting member connects said first and second housings in fixed transverse relation.

13. An apparatus according to claim 10, and further comprising a dereeler, wherein said dereeler is operatively connected to both said first and second housings.

14. A method according to claim 2, further comprising the step of operatively attaching a dereeler to said device.

15. A method according to claim 2, wherein said device comprises an actuatable mechanism which is operative to move one of said first tabs and one of said second tabs into closer relation, further comprising the step of actuating said actuatable mechanism to move said one first tab and said one second tab into closer relation to clamp said standing seam therebetween.

16. A method according to claim 15, wherein said actuatable mechanism comprises a threaded member, wherein said actuating step comprises turning said threaded member, wherein said first tab and said second tab move into closer relation responsive to turning said threaded member.

* * * * *